US006435842B2

(12) United States Patent
Song

(10) Patent No.: US 6,435,842 B2
(45) Date of Patent: Aug. 20, 2002

(54) SPRING SUPPORTING STRUCTURE OF LINEAR COMPRESSOR

(75) Inventor: Gye Young Song, Gwangmyung (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/804,235

(22) Filed: Mar. 13, 2001

(30) Foreign Application Priority Data

May 18, 2000 (KR) ..... 2000-26757

(51) Int. Cl.[7] ..... F04B 17/04

(52) U.S. Cl. ..... 417/363; 267/166; 267/109; 267/289; 267/136; 92/130 D; 92/131; 92/130 C; 417/417

(58) Field of Search ..... 417/417, 363; 267/166, 109, 289, 136; 92/130 D, 131, 130 C

(56) References Cited

U.S. PATENT DOCUMENTS 133,952 A * 12/1872 Quirk ..... 267/289
4,651,626 A * 3/1987 Messina ..... 92/13.6
5,772,410 A * 6/1998 Chang ..... 417/363
6,089,836 A * 7/2000 Seo ..... 417/415

FOREIGN PATENT DOCUMENTS

DE 3714363 A1 * 5/1987 ..... 417/417
JP 2001-329953 A * 11/2001 ..... 417/417

* cited by examiner

*Primary Examiner*—Charles G. Freay
*Assistant Examiner*—Emmanuel Sayoc
(74) *Attorney, Agent, or Firm*—Birch, Stewart, Kolasch & Birch, LLP

(57) ABSTRACT

The present invention relates to a spring supporting structure of a linear compressor which is capable of reducing the horizontal length of the compressor by reducing the overall length which adds the length of an inner resonance spring to the length of an outer resonance spring by placing at least three inner resonance springs and outer resonance springs so as to cross each other to the cylindrical direction vertical to the center line of a inner/outer spring supporters placed between an inner stator assembly and an outer stator assembly fixedly formed on a frame elastically installed inside of a casing in order to make the magnet assembly perform the linear reciprocating motion, and placing the part of the elastic region of the certain inner resonance spring so as to overlap with the elastic portion of the adjacent outer resonance spring.

10 Claims, 6 Drawing Sheets

SPRING SUPPORTING STRUCTURE OF LINEAR COMPRESSOR

BACKGROUND OF THE INVENTION

1. Field of the Invention

The present invention relates to a linear compressor, in particular to a supporting structure of a resonance spring elastically supporting an operator of a linear motor.

2. Description of the Prior Art

In general, a linear compressor is made by making a piston combine to a magnet assembly which is an operator of a linear motor as one body on the behalf of a crank shaft, it is described in FIG. 1.

As depicted in FIG. 1, the conventional linear compressor comprises a casing V where oil is filled, a compression unit installed horizontally inside of the casing V for compressing and discharging a coolant after sucking it, and an oil feeder O fixed on the outer of the compress unit C for providing the oil to the slide portion.

Hereinafter, the construction of the compress unit C comprising a supporting structure of a spring will now be described.

The compress unit C comprises a frame 1 having a ring shape, a cover 2 fixed on the side of the frame 1, a cylinder 3 fixed horizontally on the middle of the frame 1, an inner stator assembly 4A fixed on the inner circumference of the frame 1 supporting the cylinder 3, an outer stator assembly 4B installed fixedly on the outer circumference of the frame 1 so as to have a certain void from the outer circumference of the inner stator assembly 4A for forming induced magnetic with the inner stator assembly 4A, a magnet assembly 5 placed on the void between the inner stator assembly 4A and outer stator assembly 4B for performing a linear reciprocating motion, a piston 6 fixed on the magnet assembly 5 as one-body for compressing the coolant gas after sucking it while performing a sliding motion inside of the cylinder 3, and an inner resonance spring 7A and an outer resonance spring 7B for inducing the linear reciprocating motion of the magnet assembly 5 continually on the void between the inner stator assembly 4A and outer stator assembly 4B.

The inner and outer resonance spring 7A, 7B are compressed coil springs, the both ends of the inner resonance spring 7A are separately combined to the rear side surface of the frame 1 and inner side surface of the magnet assembly 5, and the both ends of the outer resonance spring 7B are separately combined to the outer side surface of the magnet assembly 5 and inner side surface of the cover corresponding to the outer side surface of the magnet assembly 5.

In addition, in the supporting structure of the inner side resonance spring 7A and outer side resonance spring 7B, each one high elasticity coil spring can be placed on the concentric, or at least three relative low elasticity coil springs can be placed on the same circumference so as to face each other with a certain interval.

A non-described reference numeral 5*a* is a magnet frame, 6*a* is a gas flow channel, 8 is an inlet valve, 9*a* is a discharge valve, 9*b* is a valve spring, 9*c* is a discharge cover, SP is an inlet pipe, and a DP is a discharge pipe.

The operation of the conventional linear compressor will now be described.

When the power is applied to the stator of the linear motor comprising the inner stator assembly 4A and outer stator assembly 4B and the induced magnetic is generated, the magnet assembly 5 as the operator placed between the stators performs the linear reciprocating motion by the induced magnetic, and the piston 6 performs the reciprocating motion of the inside of the cylinder 3.

While the piston 6 performs the reciprocating motion inside of the cylinder 3, the coolant gas flowed into the casing V is compressed inside of the cylinder 3, is discharged inside of the discharge cover 9*c* by pushing the discharge valve 9*a* of a discharge valve assembly 9, and is discharged through the discharge pipe DP. The described process is performed repeatedly.

Herein, when the magnet assembly 5 performs the linear motion horizontally by the induced magnetic between the inner stator assembly 4A and outer stator assembly 4B, the inner resonance spring 7A and outer resonance spring 7B are compressed and are stretched to the opposite direction each other, according to this the magnet assembly 5 and piston 6 perform the reciprocating motion.

However, in the spring supporting structure of the conventional linear compressor, as depicted in FIGS. 2A and 2B, because the inner resonance spring and outer resonance spring are placed on the same axial line on both sides of the magnet frame placed between them, as depicted in FIG. 3, the horizontal length of the spring supporting structure of the compressor is overall length L adding the length of the inner resonance spring L1 and length of the outer resonance spring L2, accordingly the overall horizontal length of the compressor is lengthened.

SUMMARY OF THE INVENTION

The object of the present invention is to provide a spring supporting structure of a linear compressor which is capable of reducing the horizontal direction length of the compressor by improving the defect of the conventional spring supporting structure of the linear compressor.

In order to achieve the object, the spring supporting structure of the linear compressor of the present invention comprises a frame elastically installed inside of a casing, a magnet assembly placed between an inner stator assembly and an outer stator assembly fixedly installed on the frame, and an inner resonance spring and an outer resonance spring having the phase difference separately which are placed so as to cross each other with a certain interval to the cylindrical direction vertical to the center line of the inner/outer spring supporters combined to the side of the magnet assembly and overlap some part of the elastic region of the inner resonance spring with the elastic region of the adjacent outer resonance spring.

DETAILED DESCRIPTION OF THE PREFERRED EMBODIMENT

Figure 1:
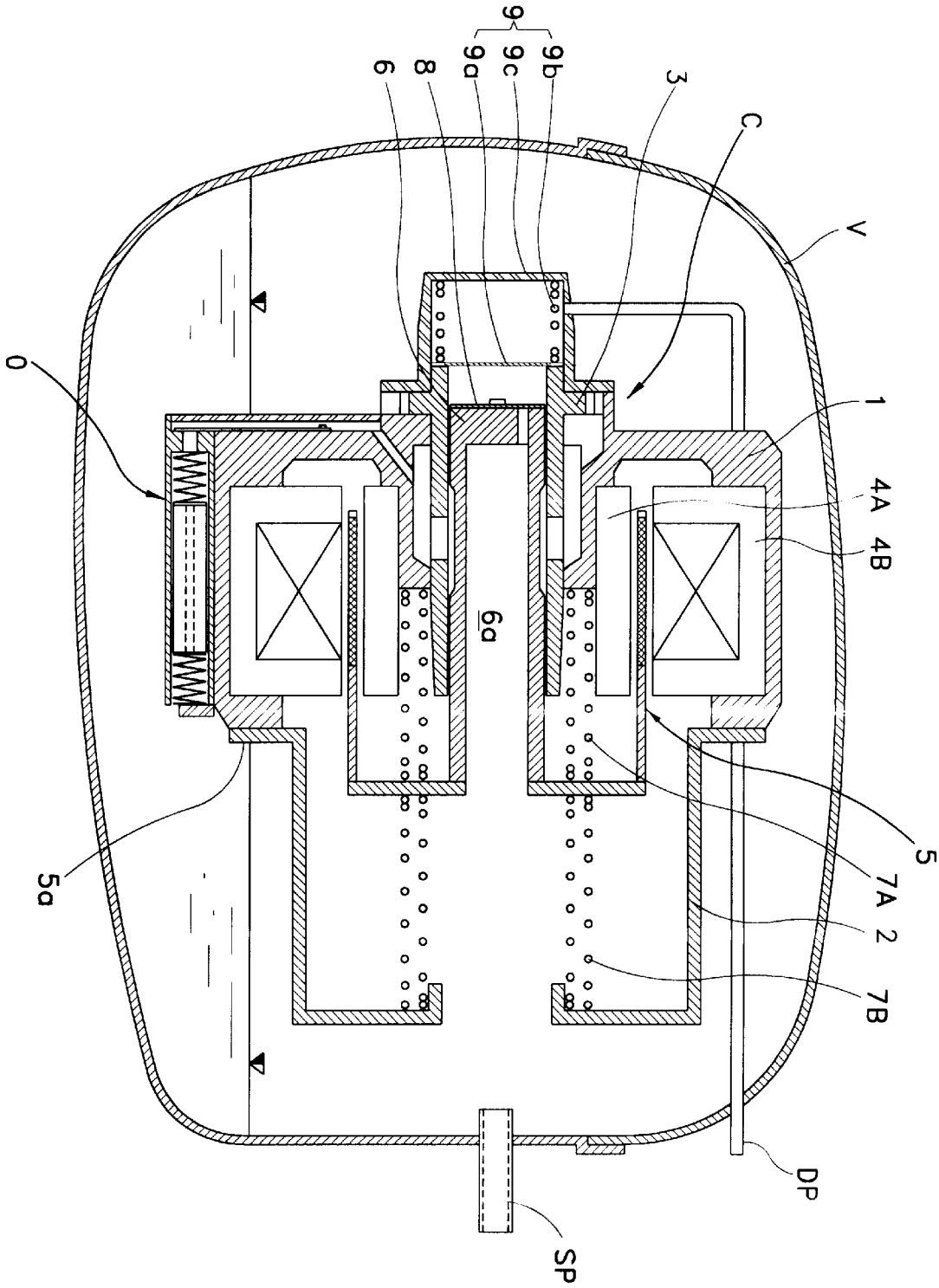
FIG. 1 CONVENTIONAL ART
FIG. 1 is a cross-sectional view illustrating the conventional linear compressor.
Figure 2A:
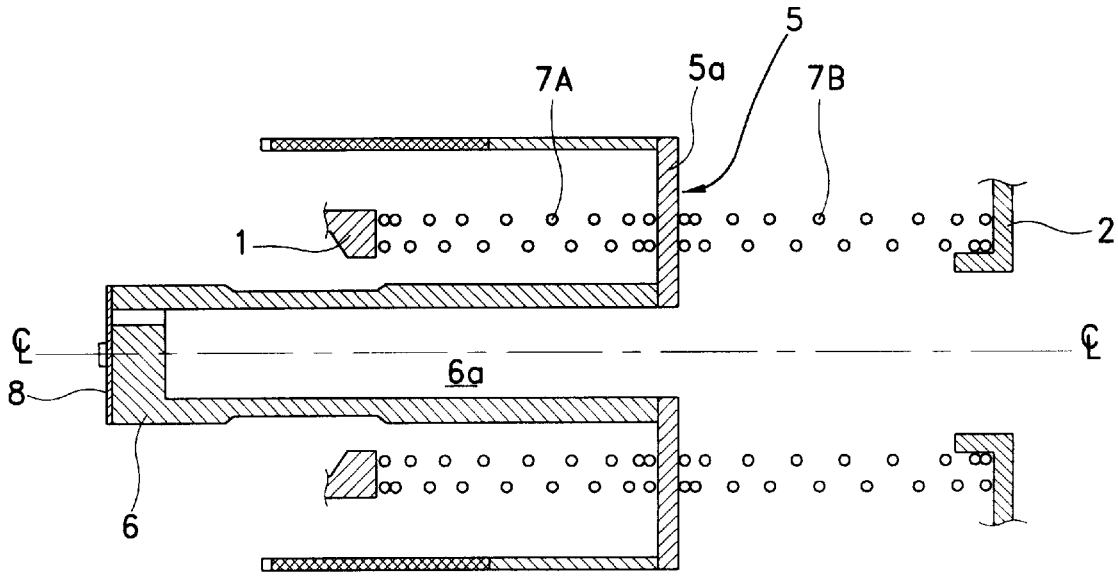
FIG. 2A CONVENTIONAL ART
FIG. 2A is a cross-sectional view illustrating the supporting state of a resonance spring of the conventional linear compressor.
Figure 2B:
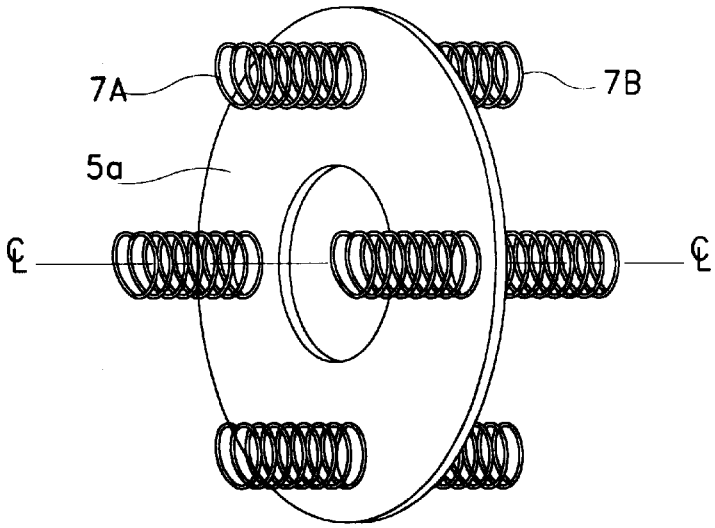
FIG. 2B CONVENTIONAL ART
FIG. 2B is a perspective view illustrating the supporting state of the resonance spring of the conventional linear compressor.
Figure 3:
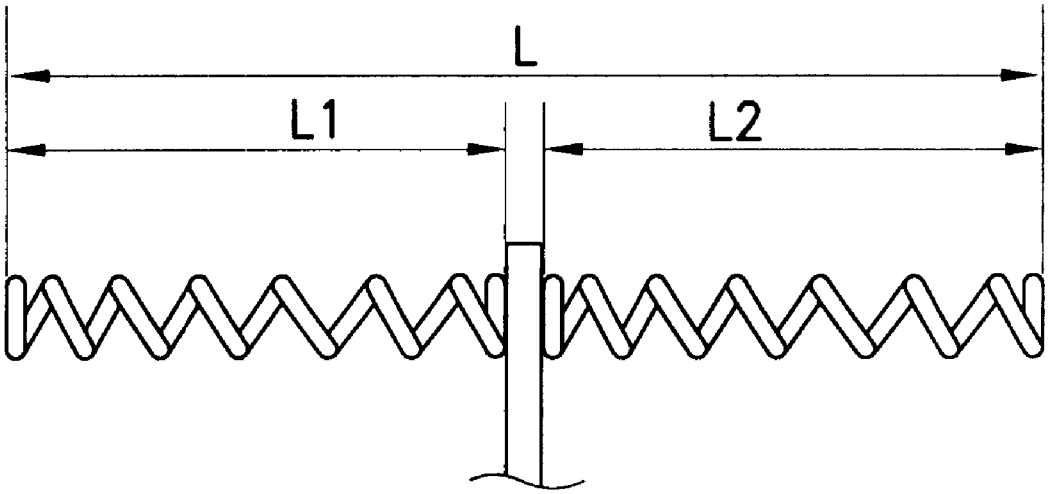
FIG. 3 CONVENTIONAL ART
FIG. 3 is a schematic view illustrating the length of the resonance spring of the conventional linear compressor.

Hereinafter, the preferred embodiment of the present invention will now be described with reference to accompanying drawings.

The same parts with the conventional technology have the same reference numerals, the description of the construction will be abridged.

Figure 4:
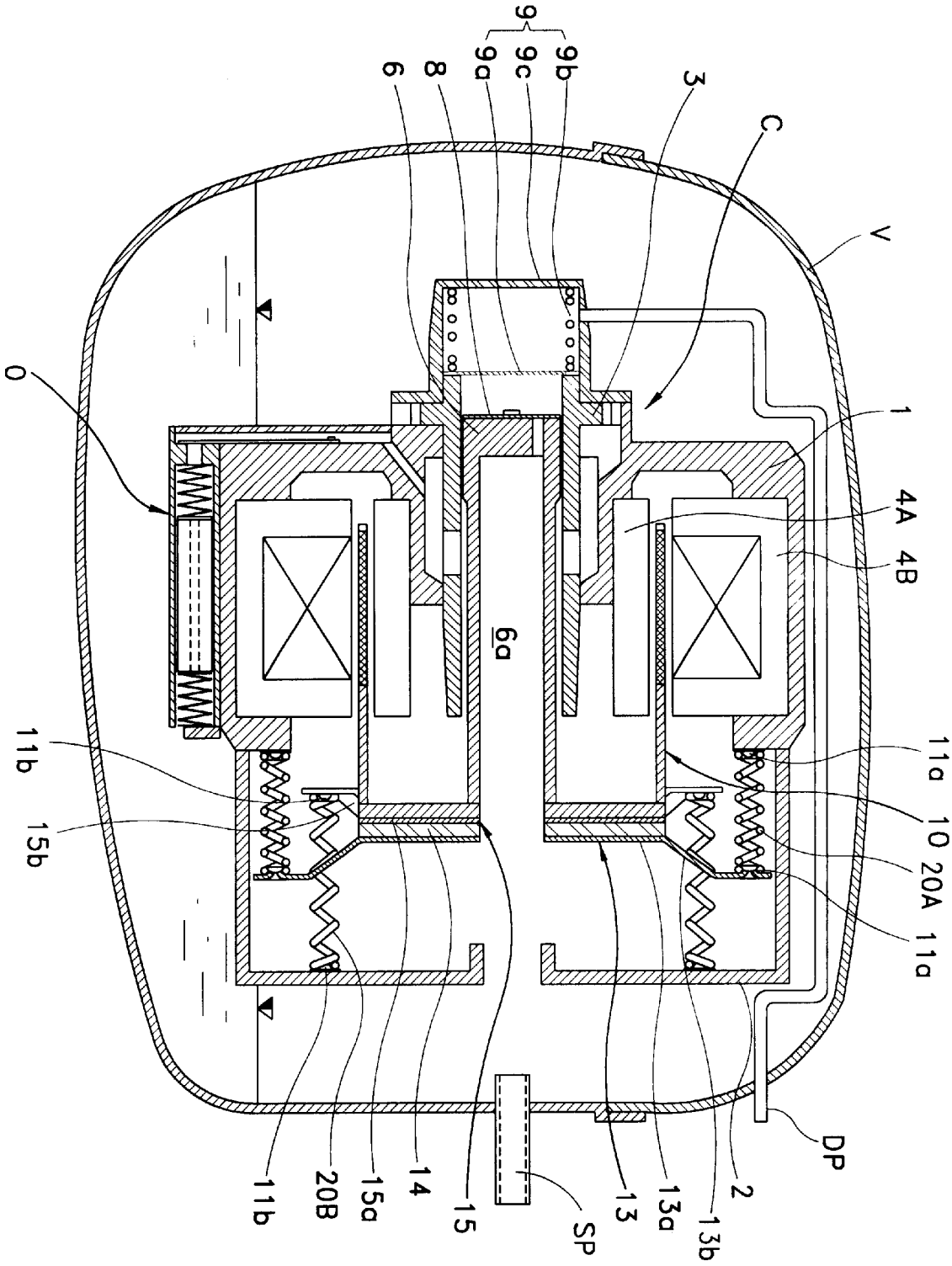
FIG. 4 is cross-sectional view illustrating the embodiment of a linear compressor according to the present invention.

In order to achieve the object, as depicted in FIG. 4, a spring supporting structure of a linear compressor of the present invention will now be described as below.

First, the spring supporting structure of the linear compressor of the present invention comprises an outer spring supporter 15 on the side surface of a magnet frame 11 included in a magnet assembly 10, a disk spacer 14 having a disk shape, and an inner spring supporter 13 which is rotated with a certain angle from the outer spring supporter 15 so as to be crossed with a leg 15*b* of the outer spring supporter 15, the inner spring supporter 13 is combined on a concentric axial line by a certain combining mean such as a bolt.

And, the spring supporting structure of the linear compressor of the present invention further comprises a plurality of inner resonance springs 20A interposed between an inner resonance spring supporting protrusion 11*a* formed on the rear side surface of a frame 1 and an inner resonance spring supporting protrusion 11*a* formed on the inner spring supporter 13, and a plurality of outer resonance springs 20B interposed between an outer resonance spring supporting protrusion 11*b* formed on the outer spring supporter 15 and an outer resonance spring supporting protrusion 11*b* formed on the inner side surface of a cover 2.

The magnet assembly comprises a magnet frame 11 having a disk shape combined to the rear end of a piston 6 as a flange form, a magnet holder 12 having a cylinder shape interposed between the inner stator assembly 4*a* and outer stator assembly 4B after combining to the outer circumference of the magnet frame 11, and a magnet cover having a ring shape for covering a plurality of magnets installed on the outer circumference of the magnet holder 12 in order to protect.

Hereinafter, the construction of the inner/outer spring supporters 13, 15 and disk spacer 14 will now be described in detail.

Figure 5A:
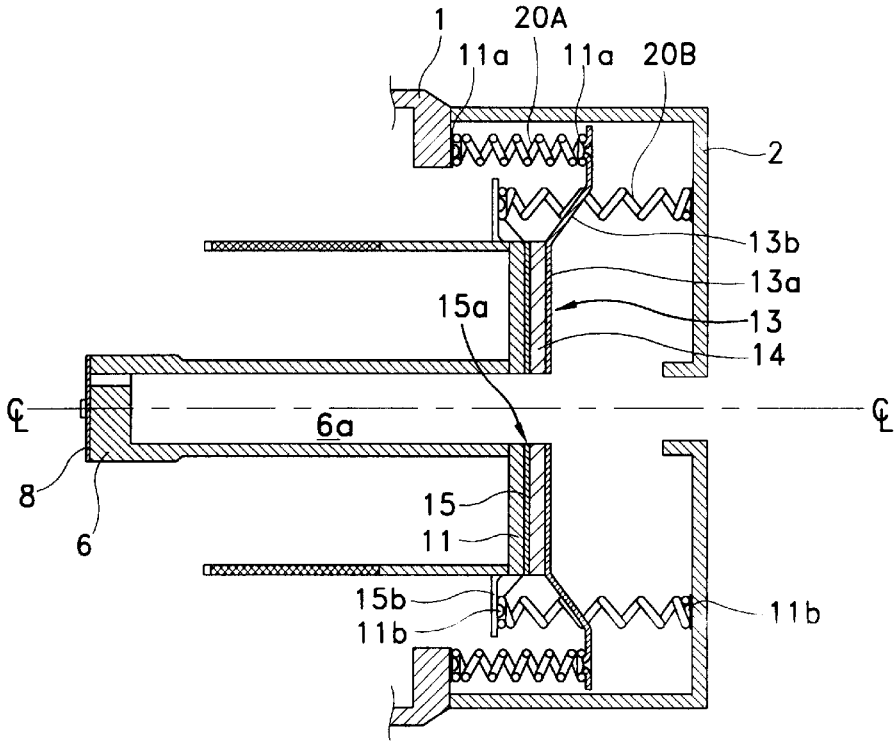
FIG. 5A is a perspective view illustrating the supporting state of a resonance spring of the linear compressor according to the present invention.
Figure 5B:
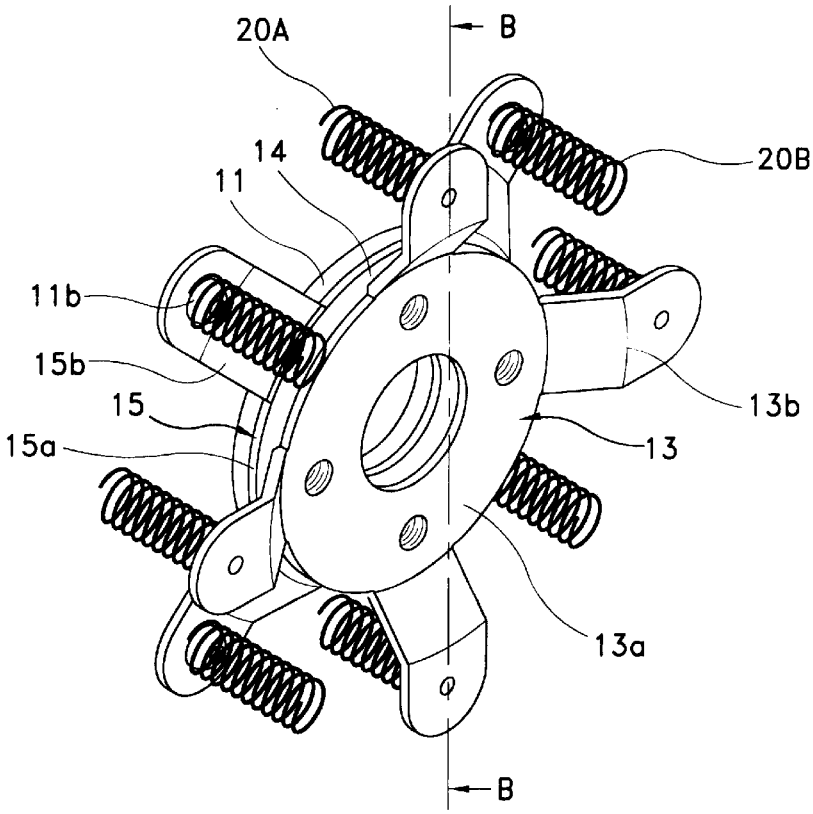
FIG. 5B is a perspective view illustrating the supporting state of a resonance spring of the linear compressor according to the present invention.

As depicted in FIGS. 5A and 5B, the outer spring supporter 15 combined to the magnet frame 10 comprises the disk 15*a* having a certain hollow on the center portion, a plurality of legs 15*b* bent toward a piston 6 and combined as one body with the disk 15*a* along the outer circumference of the disk 15*a* with regular interval, and the outer resonance spring supporting protrusion 11*b* formed on the end of the leg 15*b*. Herein, the legs 15*b* is formed so as to be bent again toward the cover 2. And, the inner spring supporter 13 comprises a disk 13*a* having a certain hollow on the center portion, a plurality of legs 13*b* bent toward the cover 2 and combined as one body with the disk 13*a* along the outer circumference of the disk 13*a* with regular interval, and the inner resonance spring supporting protrusion 11*a* formed on the end of the leg 13*b*. Herein, the legs 13*b* is formed so as to be bent again toward the piston 6.

It is advisable to form the inner/outer spring supporters 13, 15 at once with a press process.

And, the disk spacer 14 formed as a disk having a certain hollow on the center portion is combined between the inner/outer spring supporters 13, 15 in order to get the combination of the inner/outer spring supporters 13, 15 more secure.

And, the inner resonance spring supporting protrusion 11*a* and outer resonance spring supporting protrusion 11*b* formed on the inner/outer spring supporters 13, 15, frame 1 and cover 2 are placed so as to cross each other, the each inner resonance spring supporting protrusion 11*a* is formed on the same circumference with the other inner resonance spring supporting protrusion, and the each outer resonance spring supporting protrusion 11*b* placed so as to have a certain phase difference with the inner resonance spring supporting protrusion 11*a* is formed on the same circumference with the other outer resonance spring supporting protrusion 11*b*.

And, the inner resonance spring 20A is. combined between the inner resonance spring supporting protrusion 11*a* formed on the inner spring supporter 13 and inner spring supporting protrusion 11*a* formed on the rear side surface of the frame 1. In addition, the outer resonance spring 20B is combined between the outer spring supporting protrusion 11*b* formed on the outer spring supporter 15 and outer resonance spring supporting protrusion 11*b* formed on the inner side surface of the cover 2.

In addition, there are the four inner resonance springs 20A and four outer resonance springs 20B having the equal elasticity, the each inner resonance spring 20A and outer resonance spring 20B is placed so as to cross each other to the cylindrical direction vertical to the center line of the inner/outer spring supporters 13, 15 with a certain interval.

In addition, some part of elastic region of the inner resonance spring 20A or outer resonance spring 20B overlaps with the elastic region of the adjacent outer resonance spring 20B or inner resonance spring 20A.

In the accompanying drawings, non-described reference numeral 6*a* is a gas flow channel, 8 is an inlet valve, 9*a* is a discharge valve, 9*b* is a valve spring, 9*c* is discharge cover, C is a compression unit, O is an oil feeder, SP is an inlet pipe, and a DP is a discharge pipe.

The operation of the linear compressor of the present invention is same with the conventional linear compressor.

In other words, when the power is applied to the stator of the linear motor comprising the inner side stator assembly 4A and outer side stator assembly 4B and the induced magnetic is generated, the magnet assembly 5 as the operator placed between the stators performs the linear reciprocating motion by the induced magnetic, and the piston 6 performs the reciprocating motion inside of the cylinder 3. When the piston 6 performs the reciprocating motion inside of the cylinder 3, the coolant gas flowed into the casing V is compressed inside of the cylinder 3, is discharged inside of the discharge cover 9*c* by pushing the discharge valve 9*a* of the discharge valve assembly 9, and is discharged through the discharge pipe DP. The above process is performed repeatedly.

Figure 6:
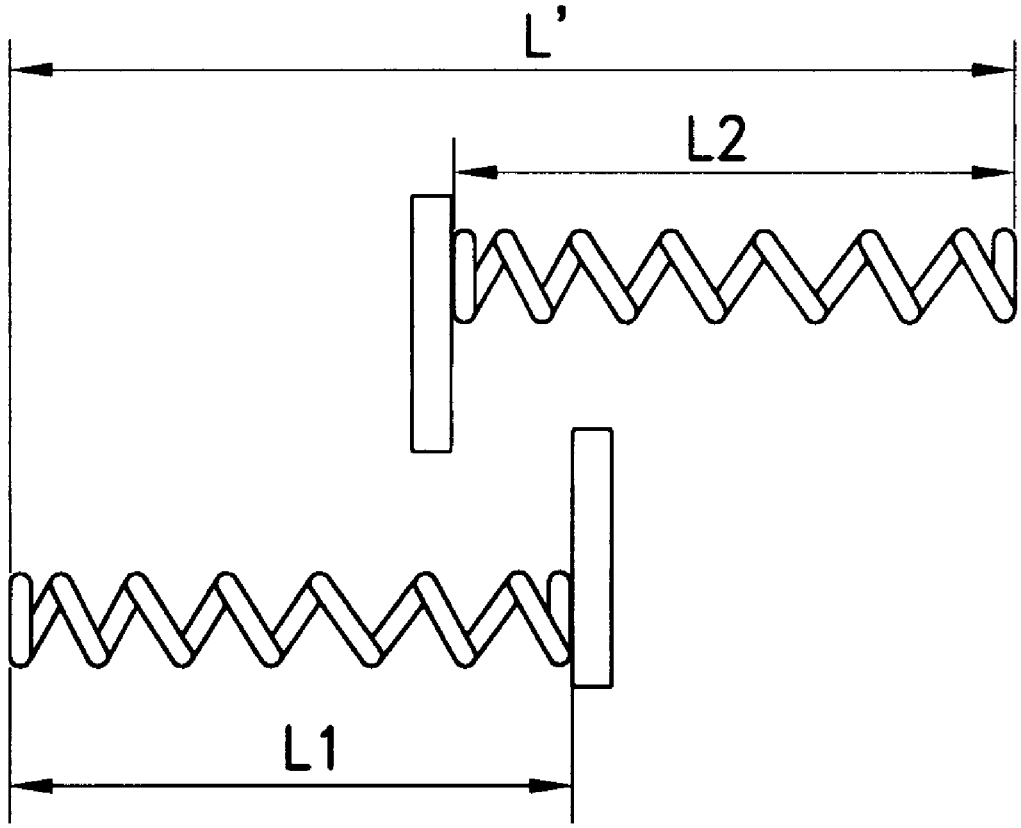
FIG. 6 is a schematic view illustrating the length of the resonance spring of the linear compressor according to the present invention.

Herein, as depicted in FIG. 6, the inner resonance spring 20A is placed so as to cross with the outer resonance spring 20B each other, the rear end of the inner resonance spring 20B is placed so as to overlap with the front end of the outer resonance spring 20B, the length L' from the front end of the inner resonance spring 20A to the rear end of the outer resonance spring 20B is shorter than the overall length L which adds the length L1 of the inner resonance spring 7A to the length L2 of the outer resonance spring 7B, accordingly the overall length of the compression unit is reduced. Because the horizontal length of the compressor casing V can be reduced, various products adapting the linear compressor of the present invention can be miniaturized.

As described above, the spring supporting structure of the linear compressor according to the present invention is capable of reducing the horizontal length of the compressor by reducing the overall length which adds the length of the inner resonance spring to the length of the outer resonance spring by placing at least three inner resonance springs and outer resonance springs supporting the both sides of the magnet assembly so as to cross each other to the cylindrical direction vertical to the center line of the inner/outer spring supporters in order to make the magnet assembly perform the linear reciprocating motion with the piston, and overlap the some part of the elastic region of the certain inner resonance spring with the some part of the elastic region of the adjacent outer resonance spring.

What is claimed is:

1. A spring supporting structure of a linear compressor, comprising:

a frame elastically installed inside of a casing;

a magnet assembly placed between an inner stator assembly and an outer stator assembly installed fixedly on the frame;

a magnet frame combined to the side of the magnet assembly;

an outer spring supporter combined to the side surface of the magnet frame so as to form supporting portion of an outer resonance spring;

a disk spacer combined to an inner spring supporter so as to have a certain interval;

the inner spring supporter combined to the side surface of the disk spacer so as to form supporting portion of an inner resonance spring; and a plurality of inner resonance springs and outer resonance springs having the phase difference separately placed so as to cross each other with a certain interval to the cylindrical direction vertical to the center line of the inner/outer spring supporters.

2. The spring supporting structure of the linear compressor according to claim 1, wherein a part of the elastic region of the inner resonance spring overlaps with a part of the elastic region of the adjacent outer resonance spring.

3. The spring supporting structure of the linear compressor according to claim 1, wherein an inner resonance spring supporting protrusion and an outer resonance spring supporting protrusion for supporting the inner resonance spring and outer resonance spring are protrusively formed on the end of a plurality of legs formed on the inner/outer spring supporters to the circumference direction so as to correspond to the number of the inner and outer resonance spring.

4. The spring supporting structure of the linear compressor according to claim 3, wherein the inner resonance spring supporting protrusion and outer resonance spring supporting protrusion are placed so as to have the phase difference separately and cross each other with a certain interval to the cylindrical direction vertical to the center line of the inner/outer spring supporters.

5. The spring supporting structure of the linear compressor according to claim 4, wherein the each inner resonance spring supporting protrusion is formed on the same circumference with the other inner resonance spring supporting protrusion, and the each outer resonance spring supporting protrusion is formed on the same circumference with the other outer resonance spring supporting protrusion.

6. The spring supporting structure of the linear compressor according to claim 1, wherein the inner resonance spring is combined between the inner resonance spring supporting protrusion formed on the inner spring supporter and inner spring supporting protrusion formed on the rear side surface of the frame, and the outer resonance spring is combined between the outer spring supporting protrusion formed on the outer spring supporter and outer resonance spring supporting protrusion formed on the inner side surface of the cover.

7. The spring supporting structure of the linear compressor according to claim 1, wherein the inner resonance spring is constructed as a plurality of compressed springs having equal elasticity, and the outer resonance spring is constructed as a plurality of compressed springs having equal elasticity.

8. The spring supporting structure of the linear compressor according to claim 7, wherein the plurality of compressed coil springs are four compressed coil springs.

9. The spring supporting structure of the linear compressor according to claim 1, wherein the spring supporting structure of the linear compressor is constructed so as to make the circumference of the plurality of inner resonance springs and the circumference of the plurality of outer resonance springs place on a same center.

10. The spring supporting structure of the linear compressor according to claim 1, wherein the disks having a hollow of the inner/outer spring supporters and the legs are fabricated as one body by a pressing process.

* * * * *